United States Patent [19]

Suzuki et al.

[11] Patent Number: 4,633,277

[45] Date of Patent: Dec. 30, 1986

[54] HEAT-SENSITIVE RECORDING MATERIAL

[75] Inventors: Toshitake Suzuki, Amagasaki; Fumio Hama, Osaka; Mitsuru Kondo, Hyogo, all of Japan

[73] Assignee: Kanzaki Paper Manufacturing Co., Ltd., Tokyo, Japan

[21] Appl. No.: 748,252

[22] Filed: Jun. 24, 1985

[30] Foreign Application Priority Data

Jun. 26, 1984 [JP] Japan ..... 59-132455

[51] Int. Cl.[4] ..... B41M 5/18

[52] U.S. Cl. ..... 346/216; 346/225; 427/150; 427/151

[58] Field of Search ..... 346/216, 217, 225; 427/150, 151, 152

[56] References Cited

FOREIGN PATENT DOCUMENTS 0008194 1/1982 Japan ..... 346/216

2127985A 4/1984 United Kingdom ..... 346/216

*Primary Examiner*—Bruce H. Hess

*Attorney, Agent, or Firm*—Armstrong, Nikaido, Marmelstein & Kubovcik

[57] ABSTRACT

This invention provides a heat-sensitive recording material comprising a base sheet and a heat-sensitive record layer formed over the base sheet and comprising a colorless or pale-colored basic dye and a color developing material capable of forming a color when contacted with the dye, the recording material being characterized in that the heat-sensitive record layer comprises as the color developing material at least one compound represented by the formula

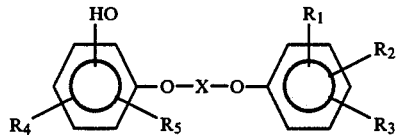

(I)

wherein X is straight- or branched-chain alkylene group having 1 to 4 carbon atoms, $R_1$, $R_2$, $R_3$, $R_4$ and $R_5$ are each hydrogen atom, halogen atom, alkyl group having 1 to 4 carbon atoms, alkoxy group having 1 to 4 carbon atoms, phenyl group or benzyl group, or $R_1$ and $R_2$, $R_2$ and $R_3$, and $R_4$ and $R_5$, when taken together, may form an aromatic ring, and when $R_4$ and $R_5$ taken together form an aromatic ring, the hydroxy group on the benzene ring to which $R_4$ and $R_5$ are attached may be substituted on the aromatic ring formed by $R_4$ and $R_5$.

3 Claims, No Drawings

HEAT-SENSITIVE RECORDING MATERIAL

This invention relates to heat-sensitive recording materials, and more particularly to heat-sensitive recording materials outstanding in high-speed recording and in colorfastness and having an unrecorded portion (background portion) less susceptible to the reduction of whiteness.

Heat-sensitive recording materials are well known which are adapted to produce record images by thermally contacting a colorless or pale-colored basic dye with an organic or inorganic color developing material.

With recent remarkable progress in heat-sensitive recording systems, high-speed recording systems have become available. For example, heat-sensitive facsimile systems produce a copy of A4 size within 20 seconds, and heat-sensitive printers achieve a recording speed of at least 120 characters/second. For use with such high-speed recording systems, there is a demand for heat-sensitive recording materials suitable for use in high-speed recording.

On the other hand, these heat-sensitive recording materials are being used in various manners with the rapidly increasing use of heat-sensitive facsimiles, heat-sensitive printers and the like, and thus are more frequently stored as laid over other record media such as diazo copying paper (diazotype paper). However, when a heat-sensitive recording material suited to high-speed recording is stored in contact with diazo copying paper, particularly such paper subjected to copying operation immediately before contact, the record image formed is markedly prone to fade or disappear and the white background portion of the recording material significantly tends to undergo the coloring (fogging) due to the action of the diazo developer and lose its whiteness. At present, it is strongly desired to remedy the foregoing serious drawbacks of the heat-sensitive recording materials for high-speed recording.

An object of the present invention is to provide heat-sensitive recording materials satisfactorily suitable for high-speed recording.

Another object of the invention is to provide heat-sensitive recording materials which, even in contact with a diazo developer, are not subject to the fading of the record images or the fogging of the background portion.

These objects and other features of the present invention will become more apparent from the following description.

This invention provides heat-sensitive recording materials comprising a base sheet and a heat-sensitive record layer formed over the base sheet and comprising a colorless or pale-colored basic dye and a color developing material capable of forming a color when contacted with the dye, the heat-sensitive recording material being characterized in that the heat-sensitive record layer contains as the color developing material at least one compound represented by the formula

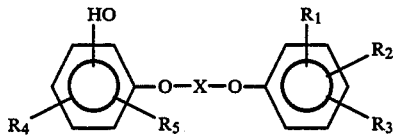

(I)

wherein X is straight- or branched-chain alkylene group having 1 to 4 carbon atoms, $R_1$, $R_2$, $R_3$, $R_4$ and $R_5$ are each hydrogen atom, halogen atom, alkyl group having 1 to 4 carbon atoms, alkoxy group having 1 to 4 carbon atoms, phenyl group or benzyl group, or $R_1$ and $R_2$, $R_2$ and $R_3$, and $R_4$ and $R_5$, when taken together, may form an aromatic ring, and when $R_4$ and $R_5$ taken together form an aromatic ring, the hydroxy group on the benzene ring to which $R_4$ and $R_5$ are attached may be substituted on the aromatic ring formed by $R_4$ and $R_5$.

We conducted extensive research to overcome the foregoing drawbacks of conventional heat-sensitive recording materials for high-speed recording and found that the fading of record images and fogging of background portion are caused by the interaction between the color developing material of the heat-sensitive recording material and the solvent component present in the developer of the diazo copying paper, particularly a mixture of ethylene glycol and its oligomers (e.g., diethylene glycol, triethylene glycol, etc.). We carried out investigations on a color developing material unaffected by the solvent component. Our investigations have revealed that the heat-sensitive recording materials prepared by using the compound of the formula (I) as the color developing material are not only suitable for use in high-speed recording but also free from the tendency to fade the record images and to fog the background portion even in contact with the diazo developer. We have accomplished the present invention based on this novel finding.

The heat-sensitive recording materials of the present invention are rendered suited to high-speed recording due to the use of compound of the formula (I). Further the present recording materials exhibit such high resistance to the developer of diazo copying paper that they are substantially free from the fading of the record images and the reduction in the whiteness of the background portion even when stored in contact with diazo copying paper immediately after copying operation.

It remains to be clarified why the compound of the formula (I) can make heat sensitive recording materials suitable for high-speed recording and resistant to a diazo developer. One of the factors which improve the above properties of the recording materials is presumably that the compounds of the formula (I) are highly miscible with the basic dye and sparingly soluble in the solvent component present in diazo developer.

Examples of groups represented by $R_1$ to $R_5$ in the compounds of the formula (I) are as follows. Exemplary of $C_1$–$C_4$ alkyl groups are methyl, ethyl, propyl, isopropyl, butyl, isobutyl, tert-butyl, etc. and illustrative of $C_1$–$C_4$ alkoxy groups are methoxy, ethoxy, propoxy, isopropoxy, butoxy, isobutoxy, tertbutoxy, etc. Examples of $C_1$–$C_4$ alkylene groups represented by X are methylene, ethylene, 1,3-propylene, 1,4-butylene, 1,2-propylene, 1,2-butylene, 1,3-butylene, 2,3-butylene, isobutylene, 2-methyl-1,3-propylene, 1,1 propylene, etc.

The aromatic ring formed by $R_1$ and $R_2$, $R_2$ and $R_3$ or $R_4$ and $R_5$ in particular constitutes a naphthalene nucleus in conjunction with the benzene ring to which $R_1$ and $R_2$, $R_2$ and $R_3$ or $R_4$ and $R_5$ are attached.

The compound of the fomula (I) can be prepared, for example, by reacting a compound represented by the formula

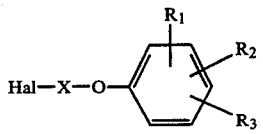

(III)

wherein Hal represents halogen atom such as chlorine, bromine, iodine and the like, and X, $R_1$, $R_2$ and $R_3$ are as defined above with a compound represented by the formula

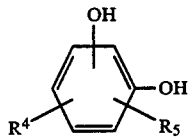

(IV)

wherein $R_4$ and $R_5$ are as defined above in the presence of an alkali. The compounds of the formulas (III) and (IV) are known compounds or can be prepared from such known compounds by a conventional method. A process for preparing the compound of the formula (I) is specifically described in Reference Example to be given later.

Because of ease of preparation, it is preferred to use the compounds of the formula (I) wherein $R_4$ and $R_5$ are hydrogen, namely compounds represented by the formula

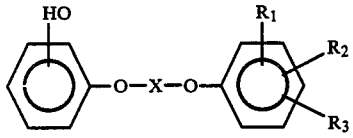

(II)

wherein X, $R_1$, $R_2$ and $R_3$ are as defined above. Further the compounds of the formula (II) wherein the hydroxyl group is at the 3-position (m-position) or 4-position (p-position) are preferred since the compounds serve to produce record images of high color density. The compounds of the formula (II) having the hydroxyl group at the 3-position are most preferred because they make heat-sensitive recording materials significantly adequate for high-speed recording.

Given below are specific examples of the compounds of the formula (I) to which those useful in the present invention are in no way limited:

1-(4-hydroxyphenoxy)-2-phenoxy-ethane (m.p. 156° C.);
1-(3-hydroxyphenoxy)-2-phenoxy-ethane (m.p. 115.5° C.);
1-(4-hydroxyphenoxy)-2-(4-methylphenoxy)-ethane (m.p. 170° C.);
1-(3-hydroxyphenoxy)-2-(4-methylphenoxy)-ethane (m.p. 134° C.);
1-(4-hydroxyphenoxy)-2-naphthoxy(1)-ethane (m.p. 196° C.);
1-(3-hydroxyphenoxy)-2-naphthoxy(1)-ethane (m.p. 160°-165° C.);
1-(5-hydroxynaphthoxy(1)) 2-phenoxy-ethane (m.p. 120° to 123° C.);
1-(3-hydroxyphenoxy)-3-(4-t-butylphenoxy)propane (m.p. 72° C.);
1-(3-hydroxyphenoxy)-3-(4-methylphenoxy)propane (m.p. 87.5° C.);
1-(3-hydroxyphenoxy)-2-(4-t-butylphenoxy)ethane (m.p. 50.5° C.);
1-(3-hydroxyphenoxy)-2-naphthoxy(2)-ethane (m.p. 173° C.);
1-(3-hydroxyphenoxy)-2-(3-methylphenoxy)ethane (m.p. 117° C.);
1-(3-hydroxyphenoxy)-3-naphthoxy(2)-propane (m.p. 108.5° C.);
1-(3-hydroxyphenoxy)-2-(4-iso-propylphenoxy)ethane (m.p. 123.5° C.);
1-(3-hydroxyphenoxy)-4-(4-isopropylphenoxy)butane (m.p. 72° C.);
1-(3-hydroxyphenoxy)-3-(4-chlorophenoxy)propane (m.p. 80.5° C.);
1-(4-hydroxyphenoxy)-2-(2-methylphenoxy)ethane;
1-(4-hydroxyphenoxy)-2-(3-methylphenoxy)ethane;
1 (4-hydroxyphenoxy)-2-(3,4-dimethylphenoxy)ethane;
1-(4-hydroxyphenoxy)-2-(2,5-dimethylphenoxy)ethane;
1-(3-hydroxyphenoxy)-2-(4-methoxyphenoxy)ethane;
1-(4-hydroxyphenoxy)-2-(4-ethoxyphenoxy)ethane;
1-(4-hydroxyphenoxy)-2-(4-propoxyphenoxy)ethane;
1-(4-hydroxyphenoxy)-3-(4-methoxyphenoxy)propane;
1-(4-hydroxyphenoxy)-2-(4-phenylphenoxy)ethane;
1-(3-hydroxyphenoxy)-4-(4-phenylphenoxy)butane;
1-(3-hydroxyphenoxy)-2-(4-benzylphenoxy)ethane;
1-(4-hydroxyphenoxy)-3-(4-benzylphenoxy)propane;
1-(4-hydroxyphenoxy)-2-phenoxy-propane;
1-(4-hydroxyphenoxy)-3-phenoxybutane;
1-(4-hydroxyphenoxy)-2-phenoxybutane;
1-(4-hydroxyphenoxy)-2-phenoxyisobutane;
1-(5-hydroxynaphthoxy(1)) 3-phenoxy-propane;
1-(5-hydroxynaphthoxy(1))-3-(4 -methylphenoxy)-propane;
1-(4-hydroxynaphthoxy(1))-2-phenoxy-ethane:
1-(3-hydroxynaphthoxy(1))-2-phenoxy-ethane;
1-(6-hydroxynaphthoxy(1))-2-phenoxy-ethane;
1-(7-hydroxynaphthoxy(1)) 2-phenoxy-ethane;
1-(4-hydroxynaphthoxy(2))-2-phenoxy-ethane; etc.

These compounds can be used singly or at least two of them are usable in admixture.

Examples of colorless or pale-colored basic dyes which can be used to form the record layer for the present heat sensitive recording materials include those heretofore known as given below.

Triarylmethane-based dyes, e.g. 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide, 3-p-dimethylaminophenyl-3-(1-methylpyrrol-3-yl)-6 - dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinaphthopyran, 3-benzyl-spiro-dinaphthopyran, 3-methyl-naphtho-(6'-methoxybenzo)spiropyran, 3-propylspiro-dibenzopyran, etc.

Lactam-based dyes, e.g., rhodamine-B-anilinolactam, rhodamine-(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamyl-)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl-)amino-6-methyl-7-phenylaminofluoran, etc.

The basic dyes useful in this invention are not limited to those exemplified above, and at least two of them can be used in admixture.

There is no specific restriction on the ratio of the basic dye and the color developing material of the formula (I) having the above-specified structure. Generally about 100 to about 700 parts, preferably about 150 to about 400 parts, by weight of the color developing material is used per 100 parts by weight of the basic dye.

These materials are formulated into a coating composition for a heat-sensitive record layer generally with use of water as a dispersion medium and a stirring or pulverizing device such as a ball mill, attritor or sand mill, by dispersing the materials at the same time or separately.

Usually the coating composition has incorporated therein a binder such as starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion and the like. The amount of the binder used is about 10 to about 40% by weight, preferably about 15 to about 30 % by weight, based on the weight of the total solids content of the composition.

Diverse auxiliary agents can be included in the coating composition. Examples of useful auxiliary agents are dispersants such as sodium dioctylsulfosuccinate, sodium dodecylbenzenesulfonate, sodium lauryl sulfate and fatty acid metallic salts, ultraviolet absorbers of the triazole or like type, defoaming agents, fluorescent dyes, coloring dyes, etc. A dispersion or emulsion of stearic acid, polyethylene, carnauba wax, paraffin wax, zinc stearate, calcium stearate, ester wax or the like can be incorporated in the coating composition in order to prevent the heat-sensitive recording material from sticking to the recording machine or thermal recording head on its contact therewith.

Insofar as the desired results of the present invention are not impaired, other additives can be contained in the coating composition. Examples of the additives are stearic acid amide, stearic acid methylenebisamide, oleic acid amide, palmitic acid amide, coconut fatty acid amide, 2,2'-methylene-bis(4-methyl-6-tert-butylphenol), 1,1,3-tris(2-methyl-4-hydroxy-5-tert-butylphenyl)butane and like hindered phenols, various thermally fusible materials heretofore known, etc.

An inorganic pigment such as kaolin, clay, talc, calcium carbonate, calcined clay, titanium oxide, diatomaceous earth, fine granular anhydrous silica, activated clay and the like can be added to the coating composition in order to eliminate or reduce the tendency for the residue to be piled on the thermal recording head.

Further the coating composition can be admixed with conventional phenol-type color developing materials such as 4,4'-isopropylidene diphenol, 4,4'-cyclohexylidene diphenol, 4,4'-isopropylidenebis(2-tert-butylphenol), 4,4'-sec-butylidene diphenol, benzyl 4-hydroxybenzoate, dimethyl 4-hydroxyphthalate, 4-hydroxy-4'-chlorodiphenyl sulfone, 4-hydroxy-4'-methyl-diphenyl sulfone, etc., insofar as the materials do not deteriorate the results contemplated by this invention. When used in conjunction with a conventional color developing material, the compound of the formula (I) preferably accounts for at least 50% by weight, based on the weight of the whole color developing components.

Base sheets which can be used for the present heat-sensitive recording materials include paper, plastics film, synthetic fiber sheet, etc. among which paper is most preferred in terms of costs, adequacy for coating, etc. The amount of the coating composition to be applied to the base sheet to form a record layer thereon is not particularly limited, but is generally about 2 to about 12 g/m$^2$, preferably about 3 to about 10 g/cm$^2$, based on the dry weight. Further an overcoat can be formed over the record layer to protect the layer. It is also possible to apply a protective coat to the rear side of the base sheet or to apply an undercoat between the record layer and the base sheet. Various other technologies known in the art are available in carrying out the present invention.

The heat-sensitive recording materials thus prepared are suitable for high-speed recording, eliminate the tendency to fade the images and to fog the background portion and involve lesser amounts of residue piled on the thermal recording head.

The present invention will be described below in more detail with reference to a reference example for preparing the compound of the formula (I), examples for preparing the heat-sensitive recording materials of the invention and comparative examples to which, however, this invention is in no way limited and in which the parts and percentages are all by weight unless otherwise specified.

REFERENCE EXAMPLE 1

To 100 ml of water were added 40 g of hydroquinone, 20 g of β-bromophenetole and 6 g of potassium hydroxide and the mixture was subjected to reaction at 80° C. for about 2 hours. The solid precipitated was filtered and washed with warm water. The unreacted materials were extracted with alkali for removal. The remaining insoluble solids were removed by filtration and the filtrate was neutralized with hydrochloric acid. The solid precipited was filtered, washed with water and recrystallized from ethyl alcohol, giving 1-(4-hydroxyphenoxy)-2-phenoxy ethane in a yield of 85%. M.p. 156° C.

EXAMPLE 1

1. Preparation of mixture A

| | |
|---|---|
| 3-(N—Cyclohexyl-N—methylamino)-6-methyl-7-phenylaminofluoran | 10 parts |
| 5% Aqueous solution of methyl cellulose | 20 parts |
| Water | 10 parts |

The above mixture was pulverized by a sand mill to a mean particle size of 3 μm.

2. Preparation of mixture B

| | |
|---|---|
| 1-(3-Hydroxyphenoxy)-3-naphthoxy(2)-propane | 30 parts |
| 5% Aqueous solution of methyl cellulose | 70 parts |
| Water | 20 parts |

The above mixture was pulverized by a sand mill to a mean particle size of 3 μm.

3. Formation of record layer

Forty parts of the mixture A, 120 parts of the mixture B, 30 parts of silicon oxide pigment (oil absorption 180 ml/100 g), 100 parts of a 20% aqueous solution of oxidized starch and 70 parts of water were mixed together and agitated to obtain a coating composition. The composition was applied to non-coated paper weighing 50 g/m$^2$ in an amount of 7 g/m$^2$ based on dry weight, and dried to give a heat-sensitive recording material.

EXAMPLE 2

A heat-sensitive recording material was prepared in the same manner as in Example 1 except that 3-(N-ethyl-N-isoamyl)amino-6-methyl-7-phenylaminofluoran was used in place of 3-(N-cyclohexyl-N-methylamino)-6-methyl-7-phenylaminofluoran employed in preparing the mixture A.

EXAMPLE 3

1. Preparation of mixture A

| | |
|---|---|
| 3-(N—Cyclohexyl-N—methylamino)-6-methyl-7-phenylaminofluoran | 10 parts |
| 5% Aqueous solution of methyl cellulose | 20 parts |
| Water | 10 parts |

The above mixture was pulverized by a sand mill to a mean particle size of 3 μm.

2. Preparation of mixture B

| | |
|---|---|
| 1-(3-Hydroxyphenoxy)-3-(4-methylphenoxy)-propane | 30 parts |
| 5% Aqueous solution of methyl cellulose | 70 parts |
| Water | 20 parts |

The above mixture was pulverized by a sand mill to a mean particle size of 3 μm.

3. Formation of record layer

Forty parts of the mixture A, 120 parts of the mixture B, 30 parts of silicon oxide pigment (oil absorption 180 ml/100 g), 100 parts of a 20 % aqueous solution of oxidized starch and 70 parts of water were mixed together and agitated to obtain a coating composition. The composition was applied to non-coated paper weighing 50 g/m$^2$ in an amount of 7 g/m$^2$ based on dry weight, and dried to give a heat-sensitive recording material.

EXAMPLE 4

A heat-sensitive recording material was prepared in the same manner as in Example 3 except that 3-(N-ethyl-N-isoamyl)amino-6-methyl-7-phenylaminofluoran was used in place of 3-(N-cyclohexyl-N-methylamino)-6-methyl-7-phenylaminofluoran employed in preparing the mixture A.

EXAMPLES 5 TO 10

Six kinds of heat-sensitive recording materials were prepared in the same manner as in Example 1 except that the compounds of the formula (I) as listed below were used in place of 1-(3-hydroxyphenoxy) 3-naphthoxy(2)-propane employed in preparing the mixture B.

| Ex. | Compound of formula (I) |
|---|---|
| 5 | 1-(3-Hydroxyphenoxy)-2-phenoxy-ethane |
| 6 | 1-(3-Hydroxyphenoxy)-2-(3-methylphenoxy)-ethane |
| 7 | 1-(3-Hydroxyphenoxy)-2-(4-isopropylphenoxy)-ethane |
| 8 | 1-(3-Hydroxyphenoxy)-4-(4-isopropylphenoxy)-butane |
| 9 | 1-(3-Hydroxyphenoxy)-3-(4-chlorophenoxy)-propane |
| 10 | 1-(5-Hydroxynaphthoxy(1))-2-phenoxy-ethane |

EXAMPLE 11

A heat sensitive recording material was prepared in the same manner as in Example 3 except that the amount of 1-(3-hydroxyphenoxy)-3-(4-methylphenoxy)propane employed in preparing the mixture B was changed to 20 parts and that 10 parts of 4,4'-isopropylidene diphenol was additionally used.

COMPARATIVE EXAMPLE 1

A heat-sensitive recording material was prepared in the same manner as in Example 1 except that 4,4'-isopropylidene diphenol was used in place of 1-(3-hydroxyphenoxy)-3-naphthoxy(2)-propane employed in preparing the mixture B.

COMPARATIVE EXAMPLE 2

A heat-sensitive recording material was prepared in the same manner as in Example 1 except that benzyl 4-hydroxybenzoate was used in place of 1-(3-hydroxyphenoxy)-3-naphthoxy(2)-propane employed in preparing the mixture B.

The 13 kinds of heat-sensitive recording materials thus obtained were caused to form images thereon with use of a heat-sensitive facsimile (Model HIFAX-700, product of Hitachi, Ltd., Japan), and the color density ($D_0$) of the recording materials was measured by a Macbeth reflection densitometer (Model RD-100R, product of Macbeth Corp., U.S. using amber filter). Table 1 below shows the results.

The whiteness of the record layer of the heat-sensitive recording materials before recording was determined by a Hunter multipurpose reflectometer and then a sheet of non-coated paper impregnated with a diazo developer (SD type, product of Ricoh Co., Ltd., Japan) was superposed on the heat-sensitive recording material. After they were left to stand in this state for 5 minutes, the whiteness of the record layer was measured in the same manner as above with the results as indicated below in Table 1.

TABLE 1

| | Color Density ($D_O$) | Whiteness (%) | Whiteness after test for diazo resistance (%) |
|---|---|---|---|
| Example | | | |
| 1 | 1.23 | 83.0 | 83.0 |
| 2 | 1.27 | 83.5 | 83.0 |
| 3 | 1.30 | 83.0 | 82.5 |
| 4 | 1.35 | 83.5 | 83.0 |
| 5 | 1.20 | 83.5 | 83.0 |
| 6 | 1.21 | 84.0 | 83.0 |
| 7 | 1.15 | 83.5 | 83.5 |
| 8 | 1.35 | 82.0 | 81.0 |
| 9 | 1.30 | 83.0 | 82.5 |
| 10 | 1.15 | 81.0 | 81.0 |
| 11 | 1.30 | 81.5 | 79.0 |
| Comp. Ex. | | | |
| 1 | 0.53 | 81.1 | 50.0 |
| 2 | 1.26 | 82.0 | 67.5 |

Table 1 shows that the heat-sensitive recording materials of this invention can produce images of high color density, thus having a high sensitivity and are suitable for high-speed recording and that the background of the material inherently has a high whiteness which is scarcely reduced when brought into contact with the diazo developer.

We claim:

1. A heat-sensitive recording material comprising a base sheet and a heat-sensitive record layer formed over the base sheet and comprising a colorless or pale-colored basic dye and a color developing material capable of forming a color when contacted with the dye, the recording material being characterized in that the heat-sensitive record layer contains as the color developing material at least one compound represented by the formula

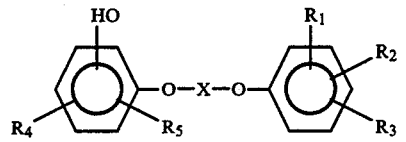

(I)

wherein X is straight- or branched-chain alkylene group having 1 to 4 carbon atoms, $R_1$, $R_2$, $R_3$, $R_4$ and $R_5$ are each hydrogen atom, halogen atom, alkyl group having 1 to 4 carbon atoms, alkoxy group having 1 to 4 carbon atoms, phenyl group or benzyl group, or $R_1$ and $R_2$, $R_2$ and $R_3$, and $R_4$ and $R_5$, when taken together, may form an aromatic ring, and when $R_4$ and $R_5$ taken together form an aromatic ring, the hydroxy group on the benzene ring to which $R_4$ and $R_5$ are attached may be substituted on the aromatic ring formed by $R_4$ and $R_5$.

2. A heat-sensitive recording material as defined in claim 1 wherein the heat-sensitive record layer contains as the color developing material a compound represented by the formula

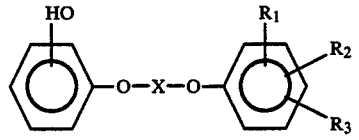

(II)

wherein X, $R_1$, $R_2$ and $R_3$ are as defined above.

3. A heat-sensitive recording material as defined in claim 1 wherein the compound of the formula (I) is used in an amount of about 100 to about 700 parts by weight per 100 parts by weight of the basic dye.

* * * * *